United States Patent [19]

Sovran et al.

[11] Patent Number: 4,865,700

[45] Date of Patent: Sep. 12, 1989

[54] PLATING BATH AND PROCESS FOR MAKING MICROPOROUS CHROMIUM DEPOSITS

[75] Inventors: Joseph G. Sovran, Novi; Robert J. Metz, Canton, both of Mich.

[73] Assignee: M&T Chemicals Inc., Woodbridge, N.J.

[21] Appl. No.: 227,967

[22] Filed: Aug. 3, 1988

Related U.S. Application Data

[63] Continuation-in-part of Ser. No. 14,312, Feb. 13, 1987, abandoned.

[51] Int. Cl.[4] ..... C25D 3/10

[52] U.S. Cl. ..... 204/51

[58] Field of Search ..... 204/51

[56] References Cited

U.S. PATENT DOCUMENTS

| | | | |
|---|---|---|---|
| 3,282,810 | 11/1966 | Odekerken | 428/613 |
| 3,625,039 | 12/1971 | Kubach et al. | 204/41 X |
| 3,745,097 | 7/1973 | Chessin et al. | 204/51 |
| 3,825,478 | 7/1974 | Clauss et al. | 204/41 |
| 4,007,099 | 2/1977 | Wu | 204/41 X |
| 4,472,249 | 9/1984 | Chessin | 204/51 |

FOREIGN PATENT DOCUMENTS

| | | | |
|---|---|---|---|
| 2317395 | 1/1974 | Fed. Rep. of Germany | 204/41 |

*Primary Examiner*—G. L. Kaplan

*Attorney, Agent, or Firm*—S. A. Marcus; R. B. Henn

[57] ABSTRACT

A composition and method are disclosed for electroplating microporous chromium layers without the requirement that microparticles be present either in the chromium layer or in a sublayer. A composition used contains chromic acid and sulfoacetic acid and, optionally, dichromate ion, sulfate ion and/or fluoride ion but being substantially free of iodide, selenide or bromide ions. A deposit having at least 20,000 micropores per square inch results. The process may be used to make multiple layer articles having an outer layer of microporous chromium.

7 Claims, 3 Drawing Sheets

MICROPOROUS CHROMIUM ARTICLE OF PRESENT INVENTION

MICROPOROUS CHROMIUM ARTICLE OF PRIOR ART

MICROPOROUS CHROMIUM ARTICLE OF PRESENT INVENTION

PRESENT INVENTION

PRESENT INVENTION

CURRENT DENSITY, asi

HULL CELL PANEL OF MICROPOROUS CHROMIUM ARTICLE OF PRIOR ART

CURRENT DENSITY, asi

HULL CELL PANEL OF MICROPOROUS CHROMIUM ARTICLE OF INVENTION

PLATING BATH AND PROCESS FOR MAKING MICROPOROUS CHROMIUM DEPOSITS

CROSS-REFERENCE TO RELATED PATENT APPLICATION

This application is a continuation-in-part of Ser. No. 014,312, filed Feb. 13, 1987 and now abandoned.

BACKGROUND OF INVENTION

1. Field of the Invention

This invention relates to chromium electrodeposits, and, particularly, to chromium electrodeposits which contain a multitude of microporous areas over substantially the entire surface area thereof.

2. Description of the Prior Art

Microporous or microdiscontinuous chromium electrodeposits are known to exhibit significantly improved corrosion resistance as compared to conventional chromium electrodeposits. In such electrodeposits, corrosion occurs at each point of discontinuity, which cannot be resolved by the unaided eye. Accordingly, microporous chromium coatings are particularly useful for decorative purposes.

Unfortunately, conventional chromium electrodeposits do not form a sufficient number of micropores to be considered an effective microporous surface. Therefore, it has been necessary to provide a suitable underdeposit on the basis metal which contains a plurality of solid particles therein. The chromium layer then assumes a microporous condition on the areas where the solid particles are present. These processes are represented by the following prior art references: U.S. Pat. Nos. 3,428,441; 3,449,223 and 3,595,762.

For example, Odekerken, in U.S. Pat. No. 3,449,223, describes a process of forming a microporous decorative chromium electrodeposit by first plating a basis metal with nickel from a bright nickel electroplating bath containing insoluble solid particles. The bright nickel coating thusproduced contains solid particles therein, which provide the chromium layer with micropores above those areas where solid particles are present.

Similarly, Chessin, in U.S. Pat. No. 3,595,762, describes an improved method and article in which two undercoat layers are provided, the first being a stratum of suitable particles formed by dipping the basis metal into a fluidized bed of such particles. The second layer thereon is an electrodeposited, conductive metal layer free of said particles, e.g. a layer containing sulfur-free nickel, which fixes the particles in the layer beneath it. The chromium deposit then is formed on the conductive layer having the particles embedded therein, thus forming the desired microporous chromium electrodeposit.

Both the above described processes, however, require one or more undercoat layers with solid particles therein. Accordingly, it would be advantageous if the chromium electrodeposit could be formed directly on the basis metal without the necessity of providing a particular undercoat layer with particles therein.

Odekerken U.S. Pat. No. 3,282,810, Examples 1 and 2 describe a method of forming microporous chromium layers. However, in order to bring about this microporous structure, use is made of colloidal particles as found in an emulsion, such colloidal particles having a particle size between 0.01 and 0.1$\mu$. These particles are present in either the underlying nickel layer or in the chromium layer itself.

In view of the foregoing, it is an object of the present invention to provide an improved microporous chromium article.

Another object herein is to provide a method of making such improved microporous chromium article.

Still a further object of the invention is to provide a chromium plating bath from which microporous chromium electrodeposits can be formed directly onto a basis metal.

Yet another object of the invention is to provide a bright, non-iridescent, non-blue haze, microporous decorative chromium electrodeposited article without intermediate layers or the chromium layer itself containing solid particles therein.

Among the other objects of the invention is to provide a chromium plating bath having high throwing power and nickel activation without producing a cloudy chromium deposit known as "white wash" which is commonly encountered when attempting to plate chromium on passive nickel surfaces.

SUMMARY OF THE INVENTION

What is provided herein is a microporous chromium article which includes a substrate, optionally, one or more metallic layers thereon, and a microporous chromium electrodeposit directly attached to a continuous layer thereunder, without using colloidal particles in the intermediate or chromium layers.

The microporous chromium electrodeposit of the invention suitably has at least 20,000 micropores per sq. in. of surface area, preferably 65,000 to 400,000 micropores per sq. in., is bright, non-iridescent, non-blue hazy, adherent, preferably has a thickness of less than $30\times10^{-6}$ inches, more preferably, about $5\text{-}20\times10^{-6}$ inches and, preferably, is formed on a bright nickel layer.

The invention includes a suitable chromium plating bath and method by which the desired microporous chromium article can be produced efficiently at predetermined chromium thicknesses without excessive microcracking, even at high current densities.

Such chromium plating bath comprises chromic acid and sulfoacetic acid, in defined concentrations, and, optionally, dichromate, sulfate and fluoride ions, and is substantially free of iodide, bromide and selenide ions.

DETAILED DESCRIPTION OF THE INVENTION

A typical microporous chromium electroplating bath in accordance with the invention has the following constituents present in g/l.

| | Suitable | Preferred |
|---|---|---|
| Constituent | | |
| Chromic acid | 100–400 | 250–300 |
| Sulfoacetic acid* | 15–100 | 30–60 |
| Optional Constituents | | |
| Dichromate ion | 0–100 | 40–60 |
| Sulfate ion | 0–3 | 0.85–1.8 |
| Fluoride ion | 0–8 | 0.2–0.8 |
| Operating Conditions | | |
| Current density, a.s.i. | 0.25–2.5 | 0.5–1 |
| Temperature, °F. | 50°–160° | 100°–120° |
| Plating efficiency, % | 20–30 at 1 a.s.i. | |
| $Cr/SO_4$ | 200:1 or greater | 300:1–500:1 |

*Sulfoacetic acid also can be present as a sulfoacetate, or isethionic acid or an isethionate, which compounds oxidize in the plating bath to provide the desired sulfoacetic acid.

A typical microporous chromium electrodeposit in accordance with the invention is formed on a succession of the following metals: a steel substrate, a copper layer thereon, followed by semi-bright nickel and bright nickel layers.

The article has the following properties:

| Properties of Microporous Chromium Layer | | |
|---|---|---|
| | Suitable | Preferred |
| Micropores - | >20,000 pores per sq. in. | 65,000–400,000 |
| Thickness - | $<30 \times 10^{-6}$ in. | $5\text{–}20 \times 10^{10-6}$ in. |
| Brightness - | Excellent | Excellent |

Figure 1:
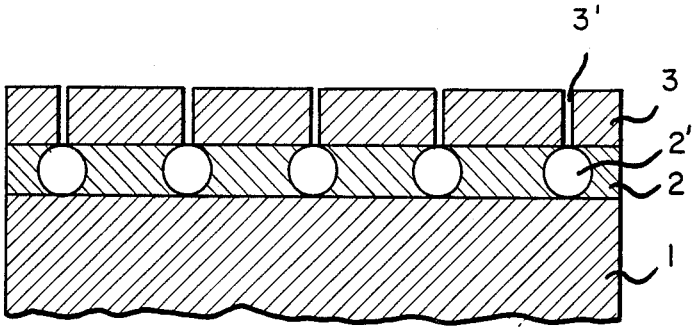
FIG. 1 shows the microporous chromium article of the prior art.

Referring now to the drawings, FIG. 1 illustrates schematically a microporous, chromium article made by the prior art methods. The article includes a substrate 1, such as steel, optionally, provided with one or more metallic layers thereon, such as copper, and semi-bright nickel. A bright nickel under layer 2 contains a plurality of particles 2', which are deposited on the substrate. Then a microporous chromium layer 3 is electrodeposited on the bright nickel underlayer 2. In those areas where particles are present, the chromium layer assumes a multiple of micropores, indicated as 3', to provide the desired microporous chromium article.

Figure 2:
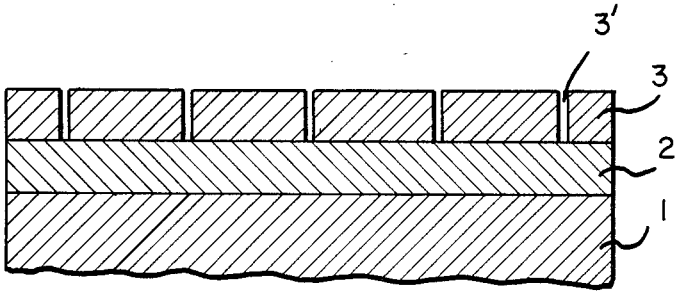
FIG. 2 is a schematic illustration similar to FIG. 1. showing the microporous chromium article of the present invention.

In the present invention, on the other hand, as shown in FIG. 2, the microporous chromium article includes a microporous chromium layer 3 formed directly on a bright nickel layer 2 which does not have any particles therein. The microporous chromium layer 3 is produced from the chromium plating bath and method of the invention. While the mechanism of microporous growth is not completely understood, it is believed that sideways growth of the chromium layer is inhibited so that micropores are produced in areas where a discontinuity in the layer is present.

Figure 3:
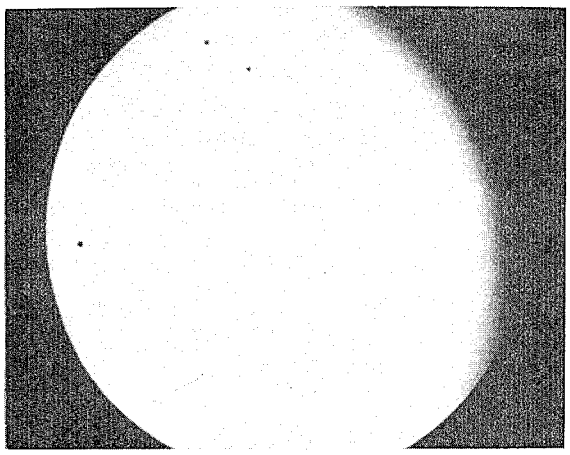
FIG. 3 PRIOR ART
FIG. 3 is a photomicrograph of a chromium layer electrodeposited from a conventional chromium plating bath.

FIG. 3 shows the structure of chromium layer plated under conventional, prior art plating conditions, i.e. a chromic acid-sulfate bath having a 100:1 $Cr/SO_4$ mole ratio.

For evaluating microporosity, the well known Dubpernell test is used, in which the article serves as cathode in an acid copper sulfate bath with a low current density. The chromium is believed to be covered by an oxide film onto which the copper does not deposit except at breaks in the chromium oxide where the underlaying substrate nickel is exposed.

The photomicrograph of FIG. 3 was taken at 83x on chromium deposited on a steel substrate at 80 $A/ft^{-2}$ (0.5 asi) in a Hull cell. The results show that essentially no pores are developed; actually only 70 pores/sq. in. was observed.

Figure 4:
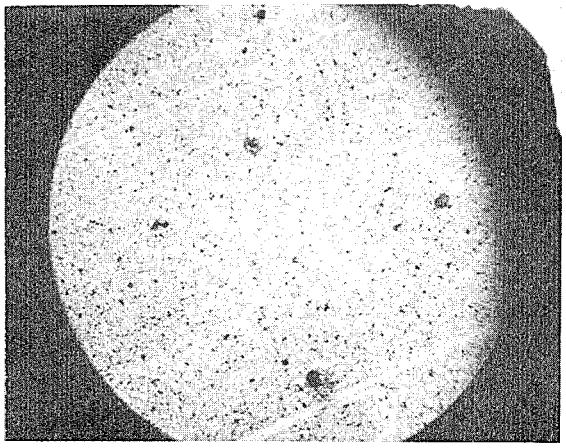
FIG. 4 is a photomicrograph of the microporous chromium layer of the present invention.

FIG. 4 shows a photomicrograph at 83x of a typical chromium layer electroplated from the bath of the present invention in a Hull cell at $80A/ft^2$ which was subjected to the Dubpernell test. The results show a multitude of micropores of 36,000 pores/$in^2$.

Figure 5:
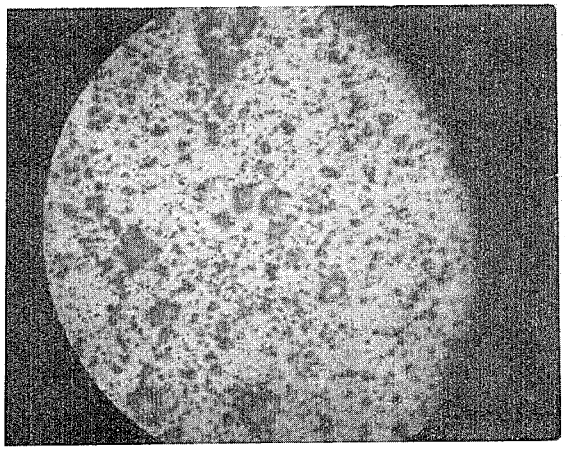
FIG. 5 is another photomicrograph of the microporous chromium layer of the invention at a higher magnification.

FIG. 5 show a similar photomicrograph at 800x of the same electrodeposit as in FIG. 4. At this magnification, a total of 280,000 pores/$in^2$ are evident.

Figure 6:
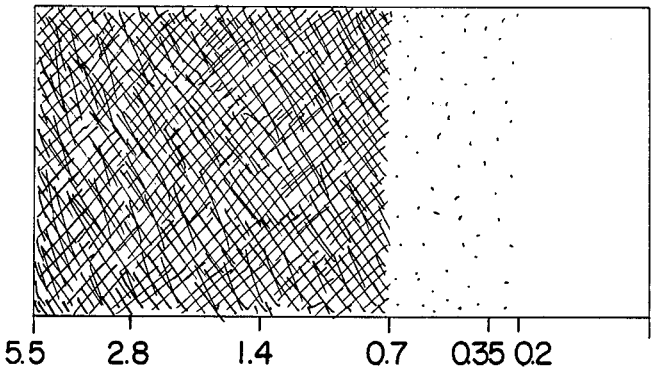
FIG. 6 is a representation of a Hull cell plating of a prior art microcracked chromium article.
Figure 7:
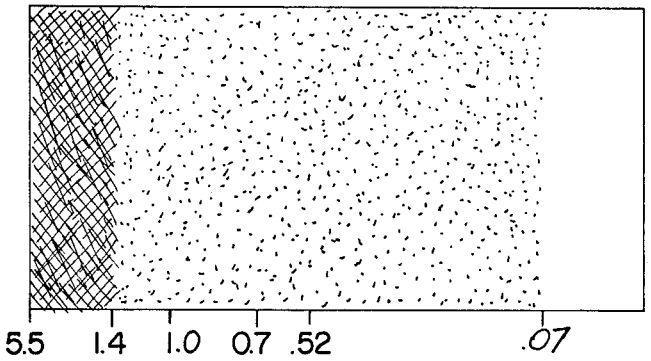
FIG. 7 is a similar illustration of a microporous chromium layer of the invention.

FIG. 6 shows a Hull cell plating sample of a typical prior art chromium article, made from standard acid hexavalent chromium plating bath. The panel shows microcracking even at low current densities, extending from 0.7 asi to severe microcracking up to 5.5 asi. Only a minimal number of micropores are present in the low current density region from 0.34 asi to 0.7 asi. On the other hand, in this invention, as shown in FIG. 7, the plating bath herein provides a chromium electrodeposit which is substantially free of microcracking over a wide current density range, extending from about 0.07 asi to 1.4 asi, and which, instead, has the desired multitude of micropores.

Preferably, the optional components are present in the bath composition for the following reasons: sulfate ion is present to increase microporosity; fluoride ion for better activation of nickel substrates and for operation at a wider current density plating range; and dichromate ion for increase microporosity in the low current density areas of plating.

The chromium plating bath of the present invention is substantially free of iodide and bromide ions, which ions adversely affect the adhesion of chromium to the substrate, and selenide ion, which reduces microporosity and increases microcracking.

The basis material which may be treated according to this invention may include a basis metal such as iron, steel, including stainless steel, brass, bronze, copper, zinc, aluminum, magnesium, nickel, etc., either pure or in the form of alloy. The preferred basis metal to be plated in accordance with this invention may be steel, zinc, or brass and most preferably steel, zinc, or brass which has been first plated with a conductive deposit such as a plate of bright nickel, typically preceded by a first plate of copper or bronze, followed by semi-bright nickel.

Other basis materials which may be treated by the process of this invention may include plastics and resins including acrylonitrile-butadiene-styrene, acetals, acrylics, alkyds, cellulosics, chlorinated polyethers, epoxies, furanes, fluorocarbons, isocyanates (urethanes), polyamides (nylons), phenoxie, phenolics, polycarbonates, polyesters, polyethylenes, silicones, polystyrenes, polyvinyls, and copolymers, etc. of these materials. When the basis material to be treated by process of this invention is a plastic or resin, the surface thereof will be treated as by deposition thereon of a conductive deposit, such as nickel or copper.

As mentioned above, the mechanism of formation of the multitude of micropores directly on a continuous layer thereunder is not well understood. However, it is known that in metal plating operations, the first atoms of metal generally deposit not to provide a continuous sheet of metal but rather at isolated nuclei. From these nuclei, the metal grain or crystal grows both horizontally and vertically. The horizontal growth (i.e. growth parallel to the substrate) from many nuclei continues until a continuous covering of the substrate results. In this invention, it is believed that such horizontal growth is inhibited so that a large number of micropores are formed in the chromium electrodeposit.

What is claimed is:

1. A chromium plating bath comprising:

| | | |
|---|---|---|
| (a) | chromic acid | 100–400 g/l |
| (b) | sulfoacetic acid | 15–100 g/l |
| (c) | dichromate ion | 0–100 g/l |
| (d) | sulfate ion | 0–3 g/l, and |
| (e) | fluoride ion | 0–8 g/l, |

which bath is substantially free of iodide, selenide and bromide ions.

2. A process for producing a microporous chromium electrodeposit which comprises electroplating from the chromium plating bath of claim 1.

3. A chromium plating bath comprising:

| | | |
|---|---|---|
| (a) | chromic acid | 250–300 g/l |
| (b) | sulfoacetic acid | 30–60 g/l |
| (c) | dichromate ion | 40–60 g/l |
| (d) | sulfate ion | 0.85–1.8 g/l, and |
| (e) | fluoride ion | 0.2–0.8 g/l, |

which bath is substantially free of iodide, selenide, and bromide ions.

4. A chromium plating bath according to claim 3 wherein the $Cr/SO_4$ ratio is about 300:1 to 500:1.

5. A process for producing a microporous chromium electrodeposit which comprises electroplating from the chromium plating bath of claim 3.

6. A process according to claim 5 wherein the current density is about 0.25–2.5 asi, the temperature is about 50°–160° F., the current efficiency is at least 20% at 1 asi, the porosity is at least the 20,000 micropores per sq. inch of its surface area at a thickness of less than $30\times10^{-6}$ in.

7. A process according to claim 6 in which about 65,000 to 400,000 micropores per sq. inch are present at a thickness of electrodeposit of about $5\text{–}20\times10-6$ inches.

* * * * *